United States Patent [19]

Donnelly

[11] 3,939,450

[45] Feb. 17, 1976

[54] ELECTRICAL COIL ASSEMBLY WITH MEANS FOR SECURING EXTERNAL LEADS

[75] Inventor: Donald E. Donnelly, Edwardsville, Ill.

[73] Assignee: Emerson Electric Co., St. Louis, Mo.

[22] Filed: Oct. 4, 1974

[21] Appl. No.: 512,066

[52] U.S. Cl. ..... 336/90; 336/192; 336/208; 336/209

[51] Int. Cl.[2] ..... H01F 27/30

[58] Field of Search ..... 336/192, 208, 198, 209, 336/90, 96; 310/194

[56] References Cited

UNITED STATES PATENTS

| | | | |
|---|---|---|---|
| 2,780,742 | 2/1957 | Jenner et al. | 336/96 X |
| 3,011,140 | 11/1961 | Mittermaier et al. | 336/208 X |
| 3,230,490 | 1/1966 | Johnson | 336/208 |
| 3,332,049 | 7/1967 | Hisano | 336/192 X |
| 3,354,417 | 11/1967 | Davis | 336/192 X |
| 3,359,520 | 12/1967 | Foerster | 336/192 |
| 3,534,312 | 10/1970 | Grasinger | 336/192 |
| 3,551,864 | 12/1970 | Sweeney et al. | 336/96 X |
| 3,634,878 | 1/1972 | Davis | 336/192 |
| 3,750,072 | 7/1973 | Weiner | 336/208 X |
| 3,750,073 | 7/1973 | Okano | 336/208 X |

*Primary Examiner*—Thomas J. Kozma
*Attorney, Agent, or Firm*—Paul A. Becker, Sr.

[57] ABSTRACT

A bobbin wound electrical coil assembly wherein external leads connected to the coil ends are secured in the flanges of the bobbin. Connector terminals connecting external lead ends and coil ends are fixed in sockets formed in one bobbin flange to preclude pulling stress on the coil end connections, and slots in the periphery of the other bobbin flange receive portions of the external leads spaced from their connected ends. A snap-on insulating cover having tabs which engage holes in the flanges of the bobbin extends between the bobbin flanges and over the external leads to cover the connections and to retain the external lead portions in the slots in the bobbin flange.

4 Claims, 13 Drawing Figures

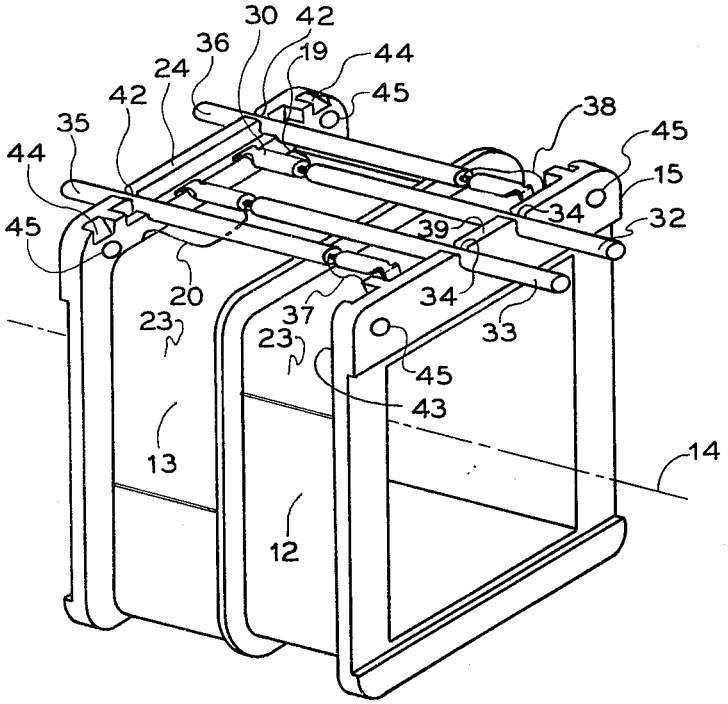
FIG. 3
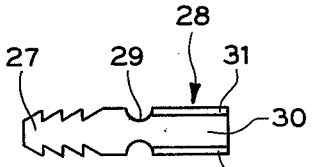
FIG. 4
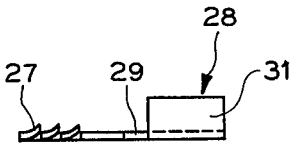
FIG. 5
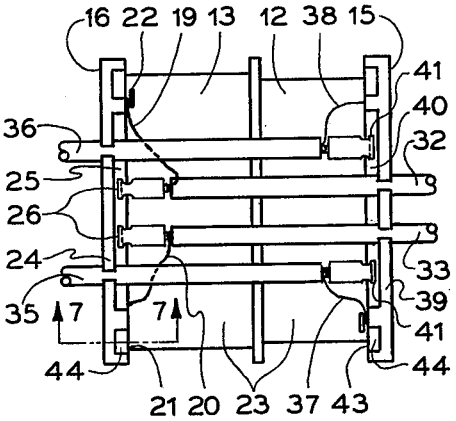
FIG. 6
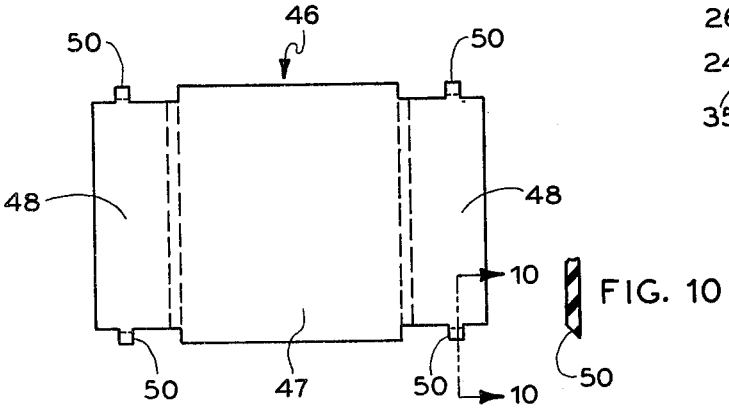
FIG. 10
FIG. 8
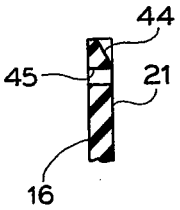
FIG. 7
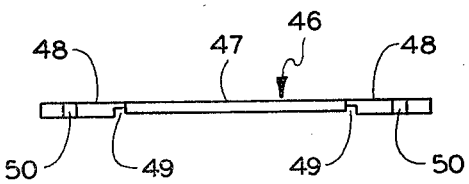
FIG. 9

ELECTRICAL COIL ASSEMBLY WITH MEANS FOR SECURING EXTERNAL LEADS

This invention relates to bobbin wound electrical coil assemblies and particularly to improved means for securing external leads to the bobbin so as to preclude strain on their connections with the coil ends and for electrically insulating the connections of the external leads to the coil ends from surrounding equipment.

BACKGROUND OF INVENTION

Electrical coil assemblies, particularly coil assemblies for transformers used in electrical control devices, require that external lead connections to the coil ends be electrically insulated from surrounding equipment and that the construction be such that a pull on the external leads will not be transmitted to the coil ends. To accomplish this, common prior art structures utilize insulative tape, rigid insulative strips, or encapsulation with an epoxy resin, or combinations thereof. Such arrangements are relatively complex and expensive to manufacture.

SUMMARY OF THE INVENTION

It is an object of this invention, therefore, to provide a generally new and improved bobbin wound electrical coil assembly having simple and inexpensive means for electrically insulating the connections between external leads and the coil ends and for securing the external leads to the bobbin to preclude stresses on the coil ends.

A further object is to provide a bobbin wound electrical coil assembly in which members connecting external leads to their associated coil ends are secured in the flanges of the bobbin and which includes an insulative snap-on cover operative to effectively insulate the coil end and lead connections from surrounding equipment and to retain the external leads in a secure position in the bobbin flanges.

Further objects and advantages will become apparent from the following description when read in connection with the accompanying drawings.

BRIEF DESCRIPTION OF THE DRAWINGS

FIG. 3 is a perspective view of the winding assembly of FIG. 2 with the external leads connected to the coil ends and showing the connector terminals and the external leads secured in the flanges of the bobbin;

FIG. 4 is an enlarged top plan view of the connector terminal used in the preferred embodiment of the invention;

FIG. 5 is a front elevation view of the connector terminal of FIG. 4;

FIG. 6 is a top plan view of the coil assembly of FIG. 3;

FIG. 7 is a cross-sectional view taken along line 7—7 of FIG. 6 showing the tapered surface and the hole in an end flange of the bobbin to facilitate installing the snap-on cover;

FIG. 8 is a top plan view of the cover of the present invention;

FIG. 9 is a front elevation view of the cover of FIG. 8;

FIG. 10 is a cross-sectional view of the tapered tab of the cover taken along line 10—10 of FIG. 8;

DESCRIPTION OF THE PREFERRED EMBODIMENTS

Figure 1:
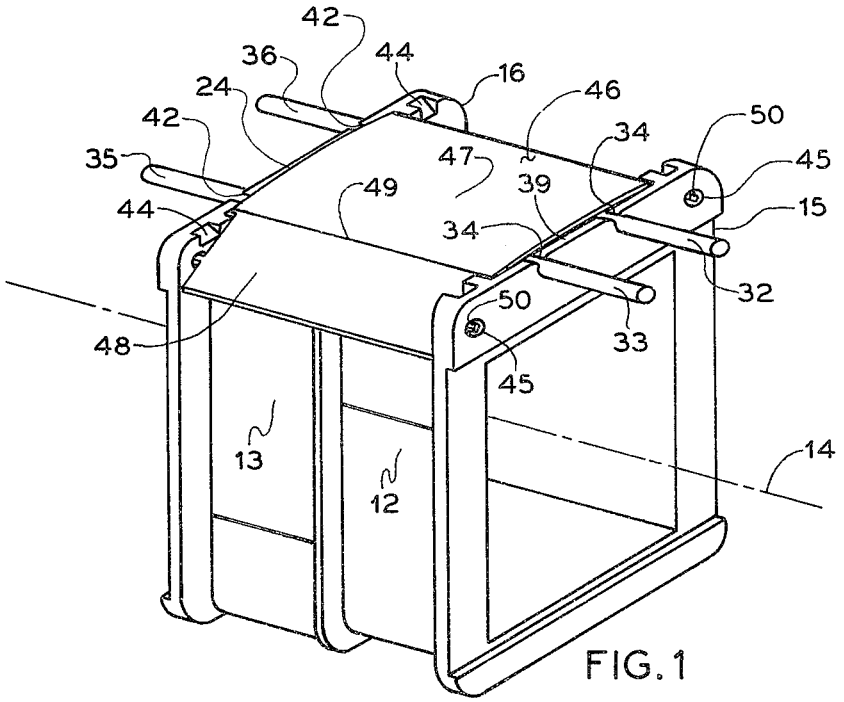
FIG. 1 is a perspective view of a coil assembly constructed in accordance with the present invention.

In the drawings, the invention is illustrated as applied to an electrical coil assembly for use in a voltage step-down transformer such as the type utilized in many electrical control devices. It will be apparent to those skilled in the art that the principles of the present invention, which are hereinafter more fully described, may be utilized in various types of electrical coil assemblies such as in multi-coil transformers, inductors, relays, and solenoids.

Figure 2:
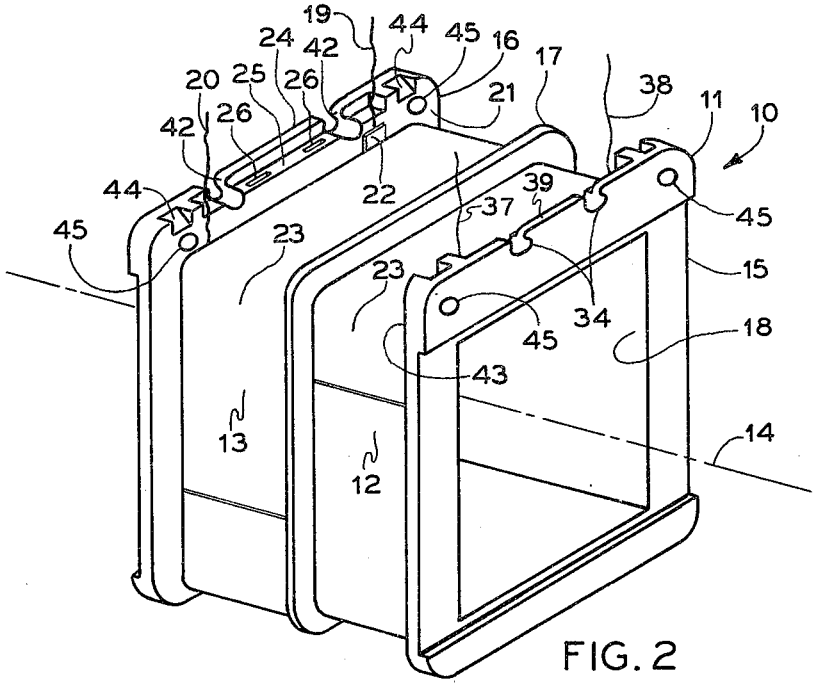
FIG. 2 is a perspective view of the coil assembly of FIG. 1 shown prior to connection of the external leads to the coil ends and with the snap-on cover removed.

Referring now to the drawings, in FIG. 2 there is shown a coil assembly 10 comprising an insulative bobbin 11 around which a high voltage primary coil 12 and a low voltage secondary coil 13 are wound in axial spaced relationship. Disposed at right angles to the longitudinal axis 14 of bobbin 11 and integral therewith are end flanges 15 and 16 and a relatively smaller intermediate flange 17, flange 17 serving to separate coils 12 and 13. Bobbin 11 has a core opening 18 which extends between end flanges 15 and 16 for receiving therein a leg of a magnetic core (not shown).

Secondary coil 13 is wound on bobbin 11 so that the start end 19 and the finish end 20 extend generally radially outwardly from bobbin 11 and adjacent the inside wall 21 of end flange 16. Any suitable means, such as a piece of insulative tape 22, can be used to electrically insulate start end 19 from the remainder of coil 13. A layer of insulative tape 23 may be wrapped around coil 13 to prevent unraveling of the turns of wire in coil 13 and to protect the top layer of wire from physical damage.

There is a ledge 25 formed on the inside of end flange 16 by a reduction in the thickness of a peripheral portion 24 of flange 16 and there are spaced rectangular sockets 26 in ledge 25 extending parallel to flange 16. Sockets 26 receive the barbed end portions 27 of connector terminals 28, shown in FIGS. 4 and 5, in force fit relationship so that once the terminals 28 have been forcibly inserted into sockets 26, the barbed end portions 27 prevent terminals 28 from being removed. As shown in FIGS. 4 and 5, connector terminal 28 consists of barbed end portion 27, a relatively narrow midportion 29, and an opposite end portion 30 having parallel spaced legs 31 extending perpendicularly therefrom. After the barbed end portion 27 of a connector terminal 28 has been pushed into a socket 26, the coil start end 19 and the stripped end of an insulated external lead 32 are inserted between legs 31 and the legs 31 are then crimped over the coil start end 19 and the stripped end of external lead 32. Connector terminal 28 is then bent, near narrow midportion 29, so that connector terminal end portion 30 and external lead 32 extend generally parallel to the axis 14 of coils 12 and 13 as shown in FIG. 3. In a similar manner, the finish end 20 of coil 13 is connected to another external lead 33. With this arrangement, a considerable pulling force on leads 32 and 33 in a direction parallel to axis 14 is resisted, thereby preventing such pulling force from being transmitted to coil ends 19 and 20.

The axially extending leads 32 and 33, which are insulated with a slightly compressible insulation such as a thermoplastic, are then pushed into slots 34, spaced from each other, in the periphery of opposite end flange 15. Slots 34 are narrower than the diameter of insulated leads 32 and 33 so that the insulation thereon is compressed as they are forcibly inserted into slots 34. The amount of compression is sufficient to enable leads 32 and 33 to resist a considerable pulling force tending to remove leads 32 and 33 from slots 34, such pulling force being due to handling of the coil assembly during the remainder of the assembly operation. Because leads 32 and 33 are retained in slots 34 against such a pulling force, connector terminals 28 are subjected to only a pulling force in a direction parallel to axis 14, thereby preventing undesirable forces on connector terminals 28 which would tend to twist or pull the terminals out of sockets 26 and thus cause a pulling force to be applied to coil ends 19 and 20. Cover means, as will be described later, retain leads 32 and 33 within slots 34 against a greater pulling force which is likely to be encountered when the coil assembly is installed in the final end product.

External leads indicated at 35 and 36 are connected to the ends 37 and 38 of the primary coil 12, which is preferably covered with a layer of insulating tape 23, in the same manner as leads 32 and 33 are connected to the ends 19 and 20 of the secondary coil 13. Referring to FIG. 6, end flange 15 has a peripheral portion 39 similar to peripheral portion 24 in flange 16, a ledge 40 similar to ledge 25 in flange 16, and spaced rectangular sockets 41 in ledge 40 identical to sockets 26 in ledge 25. Sockets 41 are, however, spaced further apart than sockets 26, see FIG. 6. As seen in FIGS. 1, 2, and 3, end flange 16 also has spaced slots 42 in the periphery thereof, identical to slots 34 but spaced further apart, for receiving insulated portions of external leads 35 and 36.

The inside walls 43 and 21 of end flanges 15 and 16 are provided with tapered surfaces 44 extending from their peripheries to holes 45, as more clearly shown for end flange 16 in FIG. 7, to facilitate receiving a snap-on cover. Referring to FIGS. 8, 9 and 10, there is provided a generally flat rectangular cover 46, made of a suitable insulating material such as nylon, having a central section 47 and end sections 48 spaced from central section 47 by intermediate sections 49 of reduced thickness. Cover 46 is secured to bobbin 11 by means of tapered tabs 50 which project from opposite sides of end sections 48. The width of end sections 48 is the same as the width of bobbin 11 between inside walls 43 and 21 of end flanges 15 and 16 but tabs 50 project sufficiently so that outer flanges 15 and 16, in the vicinity of tapered surfaces 44, are caused to deflect outwardly a small amount when tabs 50 are pressed downwardly along the tapered surfaces 44 to be entered into holes 45. When tabs 50 are seated in holes 45, outer flanges 15 and 16 return to their normal position thus confining tabs 50 in holes 45.

The sections 49 of reduced thickness permit cover 46 to be bent along these sections, as shown in FIG. 1, so that end sections 48 of cover 46 generally follow the perimeter of coils 12 and 13 so as to more adequately protect these coils from physical damage due to external forces. Central section 47 is wider than sections 48 and extends between the thinner peripheral portions 24 and 35 of flanges 15 and 16 over the ledges 25 and 40. As shown in FIG. 1, when cover 46 is installed, the central section 47 is generally on the same plane as the plane defined by the edges of peripheral portions 24 and 39. Thus, snap-on cover 46 electrically insulates the connections between external leads 32, 33, 35 and 36 and coil ends 19, 20, 37 and 38 from surrounding equipment and retains leads 32 and 33 in slots 34 and leads 35 and 36 in slots 42, such retention insuring that external leads 32, 33, 35 and 36 will resist a considerable pulling force in any direction and thus prevent stress on coil ends 19, 20, 37 and 38.

Figure 11:
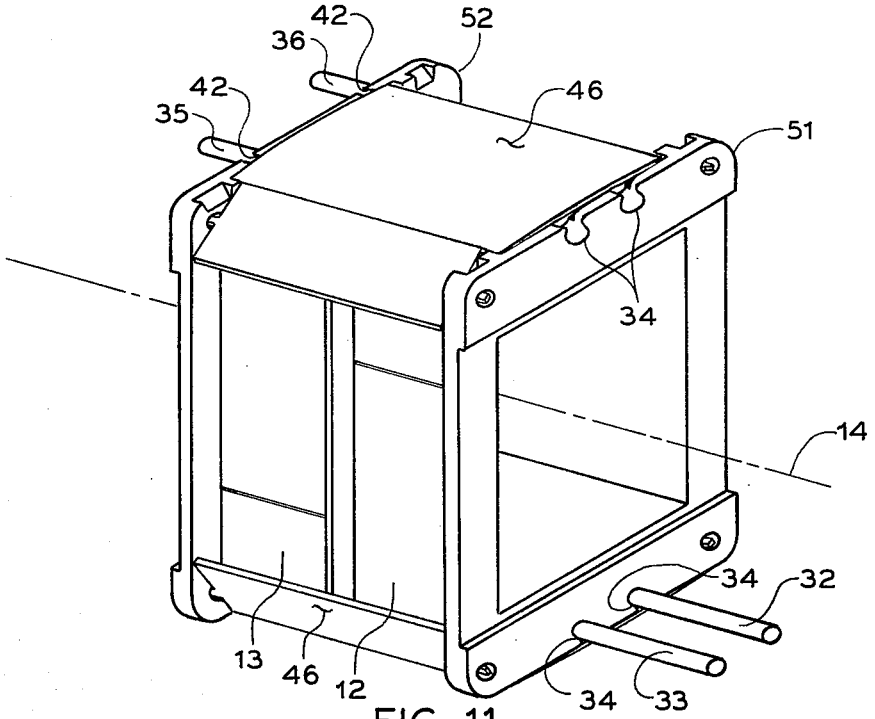
FIG. 11 is a perspective view of another form of the invention wherein external lead connections on the bobbin are made above and below the longitudinal axis of the bobbin and two snap-on covers are provided.

A second form of the invention is illustrated in FIG. 11. In this form of the invention, the portions of end flanges 51 and 52 above axis 14 are identical to the portions of previously described end flanges 15 and 16 above axis 14, and the portions of end flanges 51 and 52 below axis 14 are symmetrical with the portions of end flanges 51 and 52 above axis 14. Thus, the external leads 32 and 33 connected to the ends of coil 13 can extend through any two slots 34 in end flange 51 above or below axis 14 or one slot 34 above axis 14 and one slot 34 below axis 14, and the external leads 35 and 36 connected to the ends of coil 12 can extend through any two slots 42 in end flange 52 above or below axis 14 or one slot 42 above axis 14 and one slot 42 below axis 14.

Although not shown in FIG. 11, it is to be understood that connector terminals 28 are secured in the appropriate portions of end flanges 51 and 52, above or below axis 14, as determined by the location of the slots 34 and 42 that are utilized, and that the connector terminals 28 are secured in sockets 26 and 41 in the same manner as previously described. For example, with leads 32 and 33 retained in slots 34 in flange 51 below axis 14, as shown in FIG. 11, the connector terminals 28 connecting leads 32 and 33 with ends 19 and 20 of coil 13 are secured in sockets 26 in ledge 25 of flange 52 below axis 14. Similarly, with leads 35 and 36 retained in slots 42 in flange 52 above axis 14, the connector terminals 28 connecting leads 35 and 36 with the ends 37 and 38 of coil 12 are secured in sockets 41 in ledge 40 of flange 51 above axis 14. With this form of the invention, snap-on cover 46 cooperates with end flanges 51 and 52 above axis 14 and below axis 14 in the same manner as cover 46 cooperates with end flanges 15 and 16 above axis 14, as previously described. An advantage of this form of the invention is that desired external lead locations in flanges 51 and 52, as dictated by the electrical wiring requirements of any particular electrical control device, can be obtained simply by altering the method of manufacturing rather than requiring different parts.

Figure 12:
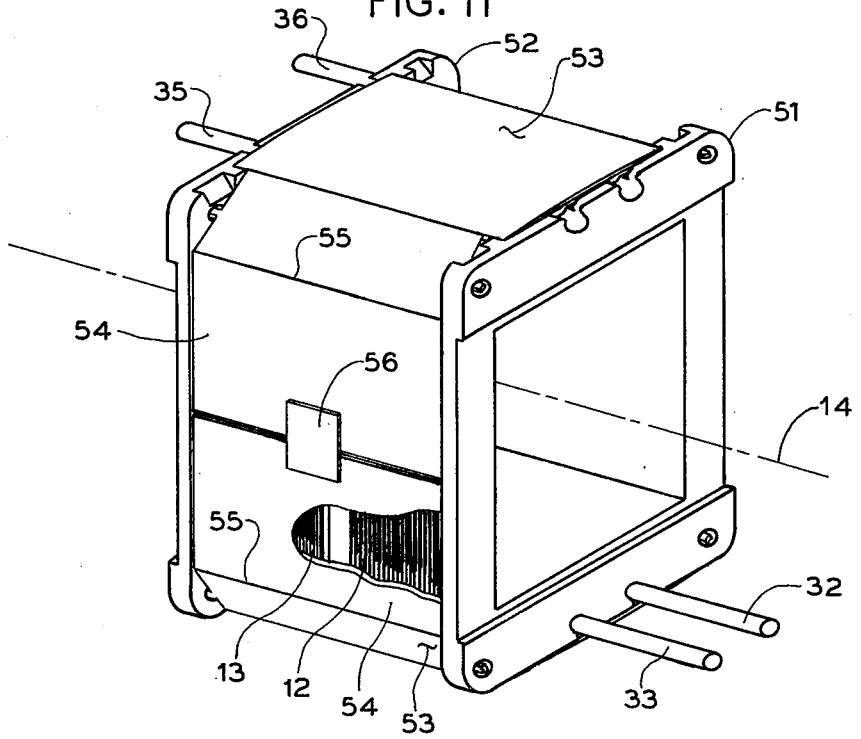
FIG. 12 is a perspective view of yet another form of in invention, similar to that shown in FIG. 11 except that the two snap-on covers are sufficiently extensive to completely surround the coils.
Figure 13:
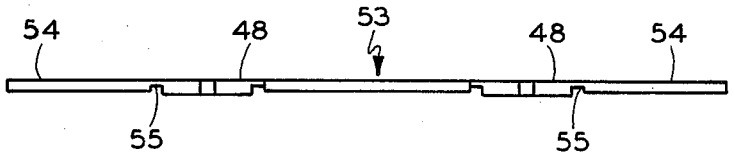
FIG. 13 is a front elevation view of the cover for use with the coil assembly of FIG. 12.

Yet another form of the invention is shown in FIGS. 12 and 13 wherein two snap-on covers 53 cooperate with the previously described end flanges 51 and 52 to completely surround coils 12 and 13. Referring to FIG. 13, cover 53 is the same as previously described cover 46 except it has additional sections 54 spaced from sections previously described as end sections 48 by additional intermediate sections 55 of reduced thickness. Referring to FIG. 12, the intermediate sections 55 permit cover 53 to be bent along these sections so that the additional sections 54 can generally follow the perimeter of coils 12 and 13.

The additional sections 54 extend sufficiently from the intermediate sections 55 so that when covers 53 are installed and the additional sections 54 are prevented from moving outwardly from coils 12 and 13 by a piece of tape 56 or by surrounding equipment such as a leg of a magnetic core (not shown), covers 53 completely surround the perimeters of coils 12 and 13 thereby more adequately protecting coils 12 and 13 against physical damage due to external forces. Covers 53 also prevent any turns of wire in coils 12 and 13 from touching any surrounding equipment so that it is unnecessary to wrap a layer of tape 23, as shown in FIG. 2, around coils 12 and 13, thereby reducing the cost of the coil assembly.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

I claim:

1. An electrical coil assembly comprising a bobbin having a pair of end flanges, a coil wound on said bobbin between said flanges and having a start end and a finish end, insulated external leads, means for connecting said insulated leads at their ends to said coil ends intermediate said flanges, said connecting means being secured to the inside wall of one of said flanges, the other of said flanges having slot means open to a peripheral edge thereof receiving therein an insulated portion of said insulated leads spaced from their connected ends, relatively rigid insulative cover means attached to said flanges and overlying said insulated leads adjacent said slot means for confining said insulated leads within said slot means, said cover means also extending between said flanges and overlying said connecting means thereby insulatingly covering said connecting means, and interengaging means on said cover means and on said flanges for providing snap-on attachment therebetween.

2. The electrical coil assembly of claim 1 in which said cover means comprises a cover having a plurality of sections spaced from each other by relatively thin intermediate sections extending transversely across said coil, said cover being bent at said intermediate sections so that said cover generally follows the perimeter of said coil.

3. The electrical coil assembly of claim 1 in which said cover means comprises two covers which extend end to end around the perimeter of said coil thereby insulatingly covering said coil.

4. An electrical coil assembly comprising a bobbin having a pair of end flanges, a coil wound on said bobbin between said flanges and having a start and a finish end, insulated external leads, means for connecting said insulated leads at their ends to said coil ends intermediate said flanges, said connecting means being secured to the inside wall of one of said flanges, the other of said flanges having slot means open to a peripheral edge thereof receiving therein an insulated portion of said insulated leads spaced from their connected ends, and means attached to said flanges and overlying said insulated leads adjacent said slot means for confining said insulated leads within said slot means, said flanges having a plurality of tapered surfaces extending inwardly from said peripheral edges and terminating in holes in said flanges, said confining means comprising a cover having tapered tabs projecting outwardly therefrom which cooperate with said tapered surfaces and said holes for providing said attachment therebetween.

* * * * *